US006371393B1

(12) United States Patent
Köhl et al.

(10) Patent No.: US 6,371,393 B1
(45) **Date of Patent: *Apr. 16, 2002**

(54) HOUSING FOR A COMMINUTION MACHINE

(75) Inventors: Erich Köhl, Meerbusch; August Van Der Beek, Grevenbroich; Manfred Adolph, Langenfeld, all of (DE)

(73) Assignee: Svedala Lindemann GmbH (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/101,142

(22) PCT Filed: Mar. 24, 1998

(86) PCT No.: PCT/DE98/00863

§ 371 Date: Jan. 7, 1999

§ 102(e) Date: Jan. 7, 1999

(87) PCT Pub. No.: WO98/42443

PCT Pub. Date: Oct. 1, 1998

(30) Foreign Application Priority Data

Mar. 26, 1997 (DE) ..... 197 12 587

(51) Int. Cl.[7] ..... B02C 13/282
(52) U.S. Cl. ..... 241/73; 241/189.1; 241/285.3
(58) Field of Search ..... 241/285.1, 285.2, 241/285.3, 189.1, 73

(56) References Cited

U.S. PATENT DOCUMENTS

| | | | | |
|---|---|---|---|---|
| 4,056,232 A | | 11/1977 | Linnerz et al. | 241/194 |
| 4,077,575 A | * | 3/1978 | Tillmanns | 241/285.3 |
| 4,193,556 A | | 3/1980 | Linnerz et al. | 241/186 |
| 4,798,345 A | | 1/1989 | Adolph | 241/186.2 |
| 4,813,620 A | * | 3/1989 | Engelmohr et al. | 241/285.3 |
| 5,244,158 A | * | 9/1993 | Popovich | 241/285.3 |
| 6,042,035 A | | 3/2000 | Grobler et al. | 241/191 |

FOREIGN PATENT DOCUMENTS

| | | |
|---|---|---|
| CH | 360 871 | 4/1962 |
| DE | 25 43 769 | 4/1977 |
| DE | 30 17 437 | 11/1981 |
| DE | 35 28 288 | 4/1987 |
| DE | 37 34 999 | 10/1988 |

(List continued on next page.)

*Primary Examiner*—Mark Rosenbaum
(74) *Attorney, Agent, or Firm*—Norris, McLaughlin & Marcus P.A.

(57) ABSTRACT

In a housing for a comminution machine with tools, which are secured to a rotor supported in the housing and which form active wear parts, such as hammers, and an anvil forming a counter tool, as well as inactive wear parts in the form of interchangeable wear plates which are secured to the rotor and also to the inside of the housing, an opening for feeding the material to be comminuted and at least one grate forming another inactive wear part, an ejection door for discharging heavy parts as well as an impact wall segment facing the ejection door and also forming an inactive wear part, and housing sections which are arranged horizontally in at least one plane, wherein at least one of the housing sections can be pivoted outwards about at least one pivot point, there is provided that at least sections of the wear parts are attached to the housing with bolts secured to the respective wear parts and form zones according to the different wear characteristics of the comminution process, so that the wear parts which are more wear-resistant than the other wear parts, are arranged around the rotor on the side walls of the housing, so that the combined characteristic features, such as their arrangement, their shape, their material composition and/or their mutual interaction, provide a matched wear characteristics of the housing and the rotor and approximately uniform maintenance intervals.

20 Claims, 9 Drawing Sheets

FOREIGN PATENT DOCUMENTS

| | | |
|---|---|---|
| DE | 37 44 241 | 7/1989 |
| DE | 36 24 826 | 2/1990 |
| DE | 40 16 295 | 11/1991 |
| DE | 93 19 599 | 3/1994 |
| DE | 43 17 288 | 5/1995 |
| DE | 197 08 185 A1 | 2/1997 |
| EP | 0 254 173 | 1/1988 |
| FR | 2 049 369 | 3/1971 |
| FR | 2 713 107 | 6/1995 |
| GB | 2 160 453 | 12/1985 |

* cited by examiner-

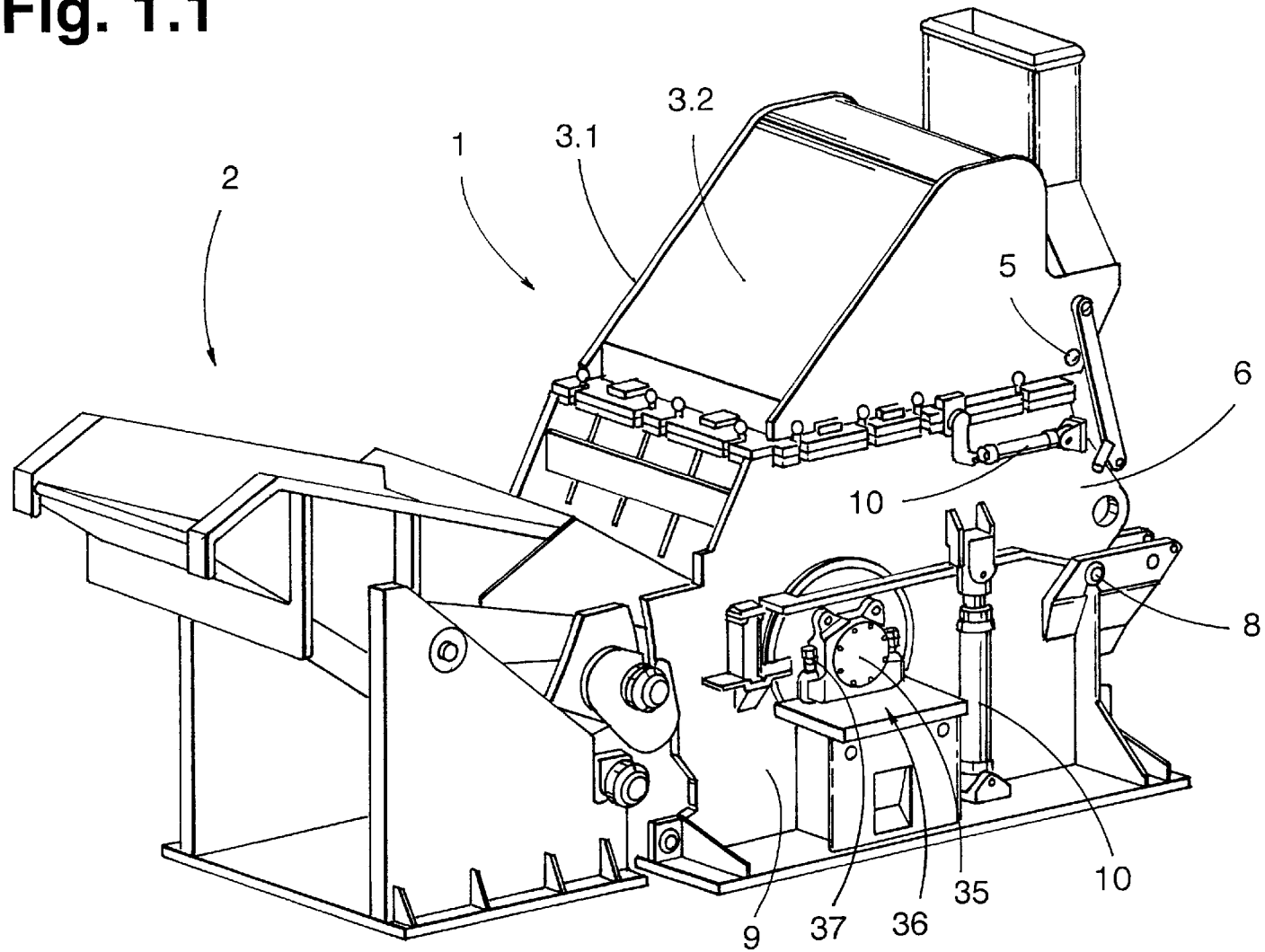
Fig. 1.1

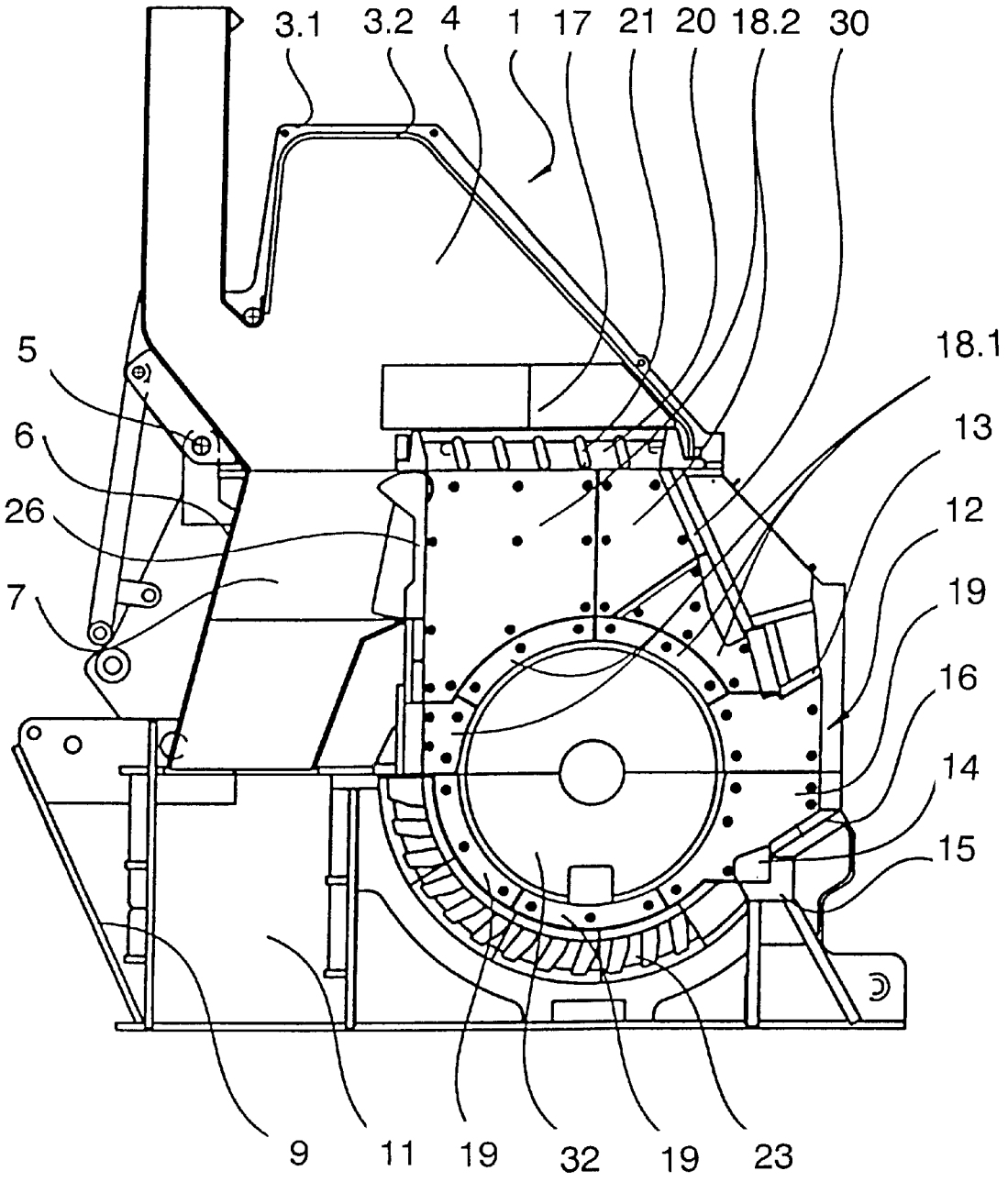
Fig. 1.2

HOUSING FOR A COMMINUTION MACHINE

FIELD OF THE INVENTION

The invention relates to a housing for a comminution machine which can be used in a system for comminuting recyclable scrap materials.

BACKGROUND OF THE INVENTION

Housings of this type are known in the art and described, e.g., in DE 24 06 204, DE 26 05 751, DE 25 43 769, DE 27 13 177, DE 32 34 298 (EP 0 103 778), DE 36 24 826 and DE 40 16 295 (EP 0 458 059). Although the link between the wear characteristics of the various housing components and the comminution process is quite complex, the basic design of such housings has essentially remained unchanged.

Certain aspects of the housings have been improved; for example, the design of the attachment of the interchangeable wear plates to the housing walls, as described in DE 24 06 204; a rotor which can be lifted with the housing cover, as described in DE 25 43 769; the discharge section for the material at the outlet side which creates a KONDIRATOR® effect, as described in DE 27 13 177; a discharge grate which is pivotally supported in the housing, as described in DE 32 34 298 (EP 0 103 778); and a swivel grate outlet as proposed in DE 40 16 295 (EP 0 458 059).

Although the solution according to DE 36 24 826 proposes an improved housing with some of the features of the present invention, the major objective of DE 36 24 826 was to reduce the costs for retrofitting a comminution machine. The effect of the wear characteristics on the housing as a whole was not addressed.

The major problems associated with current comminution machines, however, relate to controlling the relatively severe wear caused by the comminution process. This problem has been addressed in PCT 0 735 922 (PCT/EP94/04126), which describes a rotor for a comminution machine providing particularly improved wear characteristics due to improved inactive wear parts, like protective caps; the improvement has been successfully tested in practical applications, but is limited to the rotor. When the mutual interaction between the feed process for the scrap material to be comminuted (P 197 08 185.1), the actual comminution process and the discharge of the comminuted material is taken into consideration, then a housing with conventional components is no longer sufficient for providing a cost-effective and energy efficient operation.

DESCRIPTION OF THE INVENTION

It is the object of the invention to provide a housing which includes:

- tools, which are secured to a rotor supported in the housing and which form active wear parts, such as hammers, and an anvil forming a counter tool, as well as inactive wear parts in the form of interchangeable wear plates which are secured to the rotor and also to the inside of the housing;
- an opening for feeding the material to be comminuted and at least one grate forming another inactive wear part;
- an ejection door for discharging heavy parts as well as an impact wall segment facing the ejection door and also forming an inactive wear part; and
- housing sections which are arranged horizontally in at least one plane,

- wherein at least one of the housing sections can be pivoted outwards about at least one pivot point and wherein the wear characteristics of the housing and the comminution process are matched to each other.

It is another object of the invention to provide consistent service and/or maintenance intervals for the operation. It is yet another object of the invention to provide cost-effective and energy-efficient operating conditions and improved spare parts logistics.

These objects of the invention are solved by connecting at least sections of the wear parts to the housing with bolts attached to the respective wear parts and thereby forming different zones corresponding to the different wear characteristics during the comminution process. Wear parts which are more wear-resistant than the other wear parts, are arranged around the rotor on the side walls of the housing, so that these synergistic features, i.e. the design, material composition and/or mutual arrangement of the wear parts provide balanced matched wear characteristics of the housing and the rotor with approximately uniform maintenance intervals. An upper housing section has a bent continuous thick plate; wear parts which are more wear-resistant than the wear parts mentioned previously, are secured to the side walls of a center housing section between the upper grate and the rotor; and wear parts which are more wear-resistant than the latter wear parts, are disposed on the side walls of the center housing section and a lower housing section in the region around the rotor.

The invention thus advantageously provides differentiated wear zones which are matched to the wear characteristics.

In an embodiment of the present invention, an upper grate includes unbreakable reinforced rods, an upper edge of the opening is coated to improve wear resistance, a continuous wear segment is disposed between the anvil and a lower grate, and the lower grate has lateral upwardly pointing edges which abut the wear parts and the wear segment, respectively, to protect against penetration by comminuted material.

Additional advantageous embodiments, as described below, emphasize the particular industrial applicability of the invention with respect to service, maintenance and/or the exchange of worn parts. Additional advantageous embodiments combining known features with the characterizing features of the present invention provide additional solutions for the problems and the object of the invention.

The invention, as well as variations thereof, are described hereinafter with reference to an embodiment.

BRIEF DESCRIPTION OF THE DRAWINGS

In the drawing is shown in:

FIG. 1.1 a perspective view of the housing of the invention with a feeder for the scrap material to be comminuted;

FIG. 1.2 a side view of the housing of FIG. 1.1 in cross-section;

FIG. 3 the upper section of the housing with:

Figure 5:
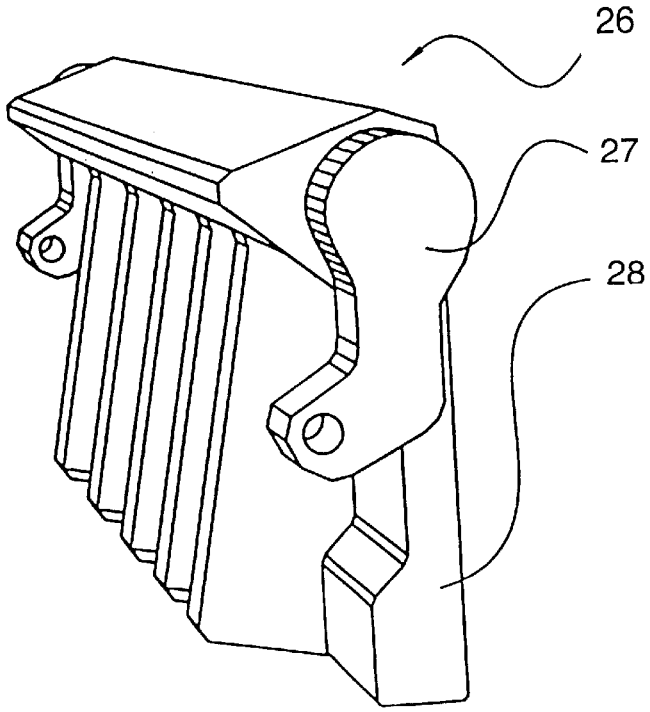
Figure 6:
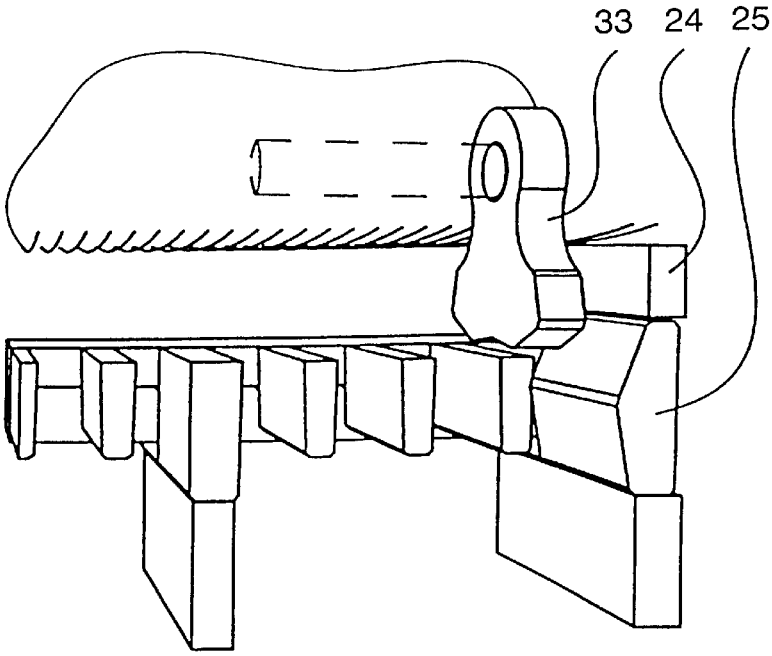
Figure 7:
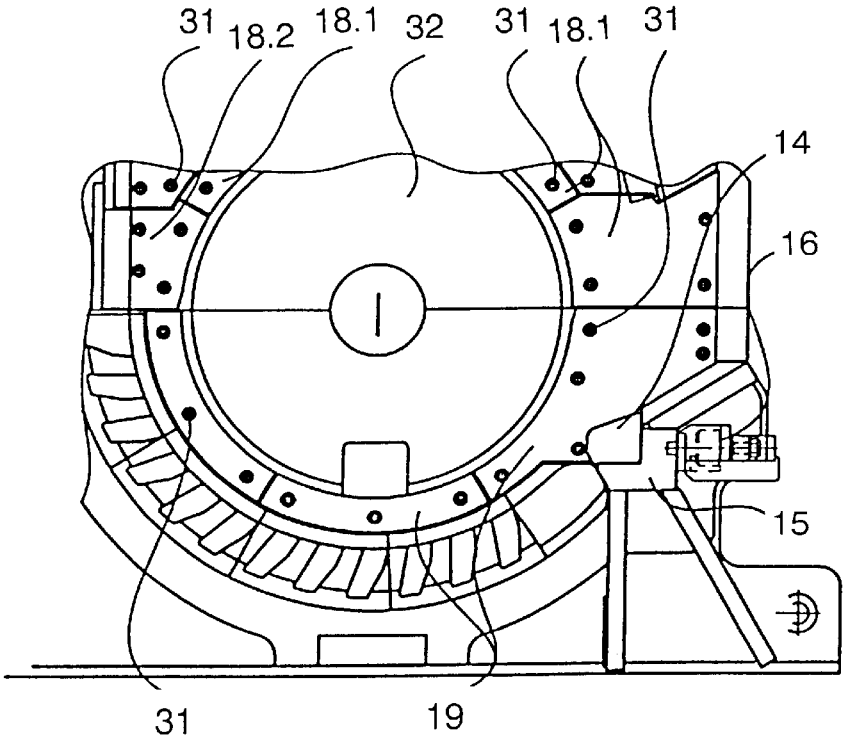
Figure 8:
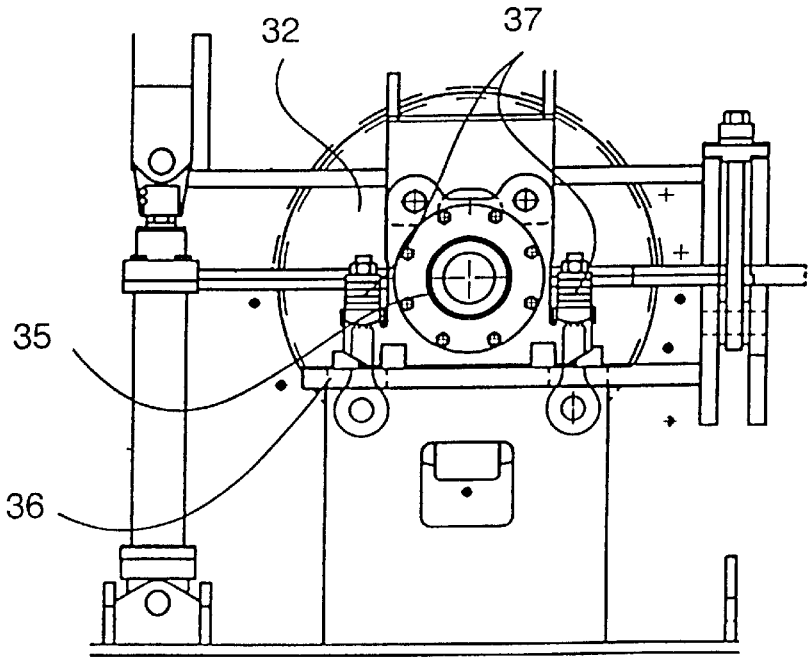

a) the cover of the upper grate pivoted outwards; and b) the cover of the upper grate pivoted inwards;

FIG. 4 the housing which can be pivoted outwards in three different ways:

a) in the normal position;

b) with the upper and middle section pivoted outwards and the rotor supported on the lower section;

c) pivoted outwards as in b), however, with the rotor lifted out and secured to the center section;

d) with the upper section pivoted outwards; and e) a partial view of d);

FIG. 5 a perspective partial view of the lower grate with a lateral edge portion extending to an inactive wear part and a corresponding hammer forming an active wear part;

FIG. 6 the ejection door made as one piece;

FIG. 7 a partial view of FIG. 1.2, in particular with the anvil and the associated tensioning assembly; and FIG. 8 the rotor support.

DETAILED DESCRIPTION OF A PREFERRED EMBODIMENT

Referring now to FIG. 1.1, there is depicted a housing 1 with an upper section 3.1 which can be pivoted about a pivot point 5 with the help of a device 10, and a continuous bent plate 3.2. A center housing section 6 can be pivoted with the device 10 about the pivot point 8. A rotor 32 depicted in FIGS. 1.2, 4, 7 and 8 is supported by a bearing 35 which is secured to a support 36 through tensioning elements 37. Also secured to the upper housing section 3.1 is an upper grate 20 which is illustrated in FIGS. 1.2, 2, 3, 4*a*. In the operating position, the upper housing section 3.1, the center housing section 6 and a lower housing section 9—which together form the housing 1—are interlocked with each other. The scrap materials (not shown) to be comminuted are conveyed to housing 1 by a feeder 2 which is not described in detail.

The housing 1 and the rotor 32 which together form a functional unit, are implemented by using a known bearing arrangement 35 which has been used by the applicant since 1990 and which permits the rotor 32 to move relative to the support 36 when large scrap material parts which are difficult to comminute, enter the comminution machine. For this purpose, tensioning elements 37 are disposed between the support 36 and the bearings 35, as illustrated in FIG. 8. The tensioning elements 37 can be constructed of conventional disk springs and fastening bolts or of hydraulically tensioned fastening members of the type used by the applicant, which are not shown here.

The characteristic features of the invention are illustrated in FIG. 1.2 and include the housing 1 with the rotor 32; an anvil 14 which acts as a counter-tool for the hammers 33 (FIG. 1.1) and is located in the support 15 with a tensioning device 16, e.g. with hydraulic elements, providing a constant bias force (FIG. 7); furthermore an opening 12 for introducing the materials to be comminuted; the upper grate 20 with rods 21; a pivotable ejection door 26 for discharging heavy parts; an impact wall segment 30 facing the ejection door 26; and the upper housing section 3.1 with side walls 4, the center housing section 6 with side walls 7, and the lower housing section 9 with side walls 9.

With the present invention, the service and/or maintenance intervals can be matched to the wear characteristics of housing 1 and to the comminution process by securing inactive wear parts (17, 18.1, 18.2, 19) to the housing 1 with screws 31 affixed to the inactive wear parts, preferably by pressing knurled heads screws into pre-drilled holes. In addition, zones with different characteristics corresponding to the wear during the comminution process are formed by, for example, attaching those wear parts 18.1, 19, which are more wear-resistant relative to the other wear parts 18.2, 17, on the side walls 7, 11 around the rotor 32.

Figure 2:
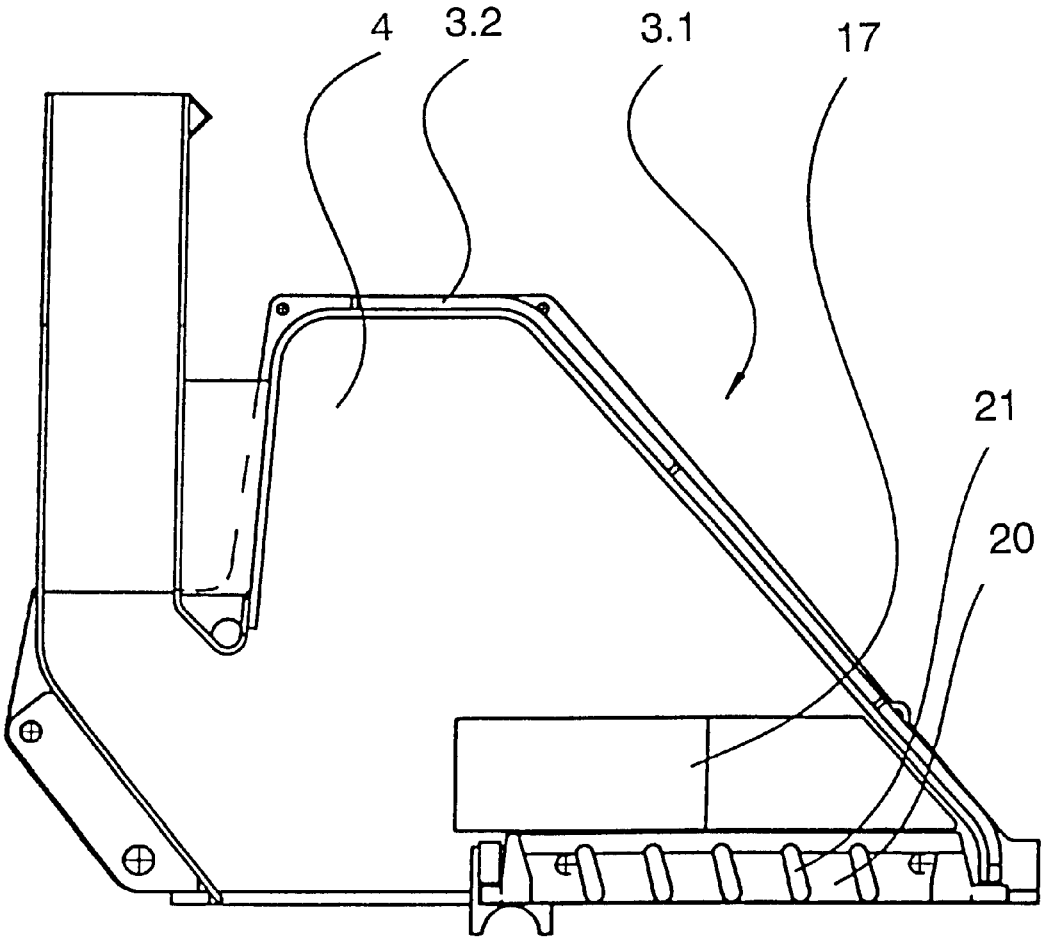
FIG. 2 the upper section of the housing of FIG. 1.2.

As depicted in FIG. 2, the upper housing section 3.1 is here made of the continuous bent thick plate 3.2 and of the wear parts 17 disposed on the side walls 4 above the upper grate 20.

Between the upper grate 20 and the rotor 32, the side walls 7 of the center housing section 6 include wear parts 18.1 which are more wear-resistant than the wear parts 18.2. The side walls 7 and 11, respectively, of the center housing section 6 and the lower housing section 9, respectively, are provided with wear parts 18.1 in 19, respectively, in the region around the rotor 32 which are more wear-resistant than the wear parts 18.2 (FIG. 7). Consequently, essentially three different zones with differentiated wear characteristics are formed.

To functionally cooperate with the wear parts, the upper grate 20 includes essentially unbreakable reinforced rods 21; an upper edge 13 of the opening 12 is provided with a wear-resistant coating; a continuous wear segment 24 is disposed between the anvil 14 and a lower grate 23, as illustrated in FIG. 5; and the lower grate 23 has lateral upwardly pointing edges 25 which abut the wear parts—in the present example the wear segment 24—to protect against penetration by comminuted material.

The aggregate of the characterizing features of the present invention has a synergistic effect, namely to provide a cost-effective and energy-saving comminution machine with uniform service and repair intervals and optimized spare parts logistics.

Figure 4B:
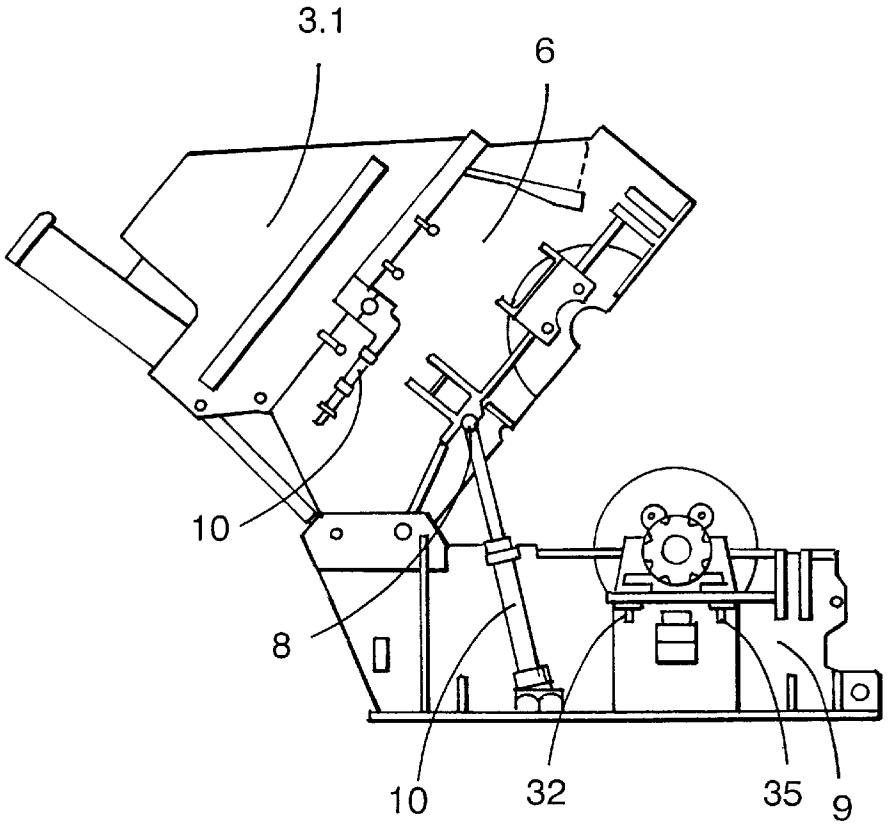
Figure 4A:
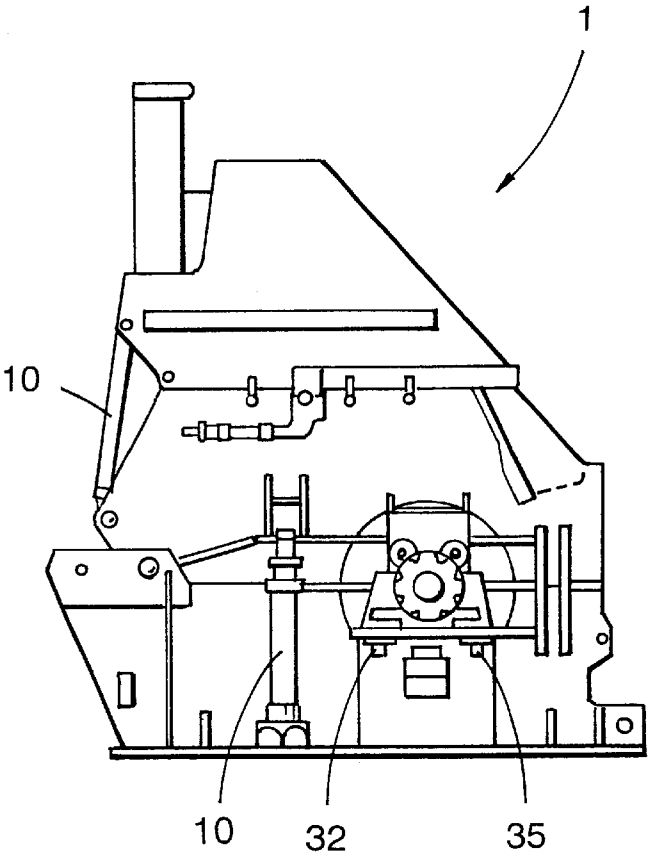
Figure 4D:
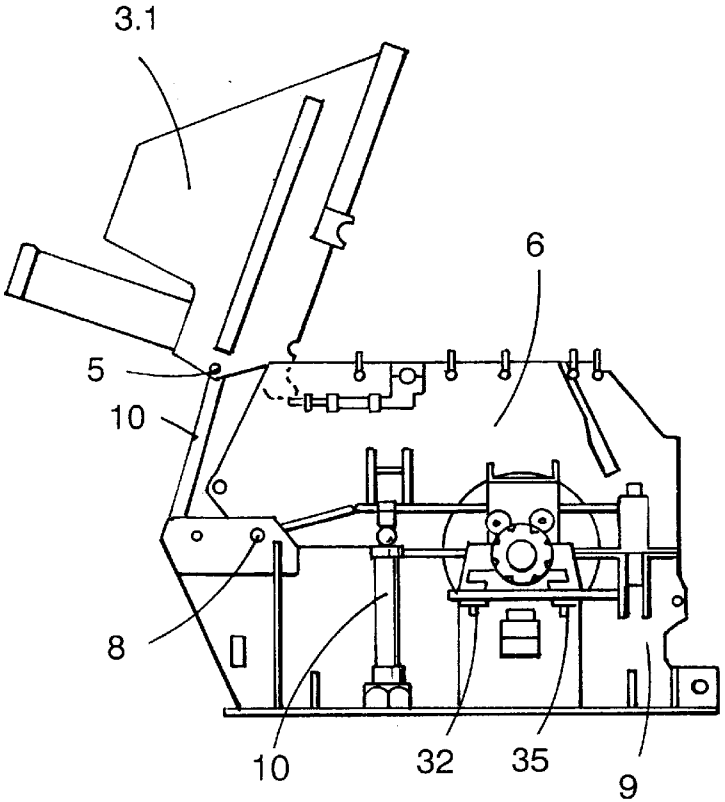
Figure 4C:
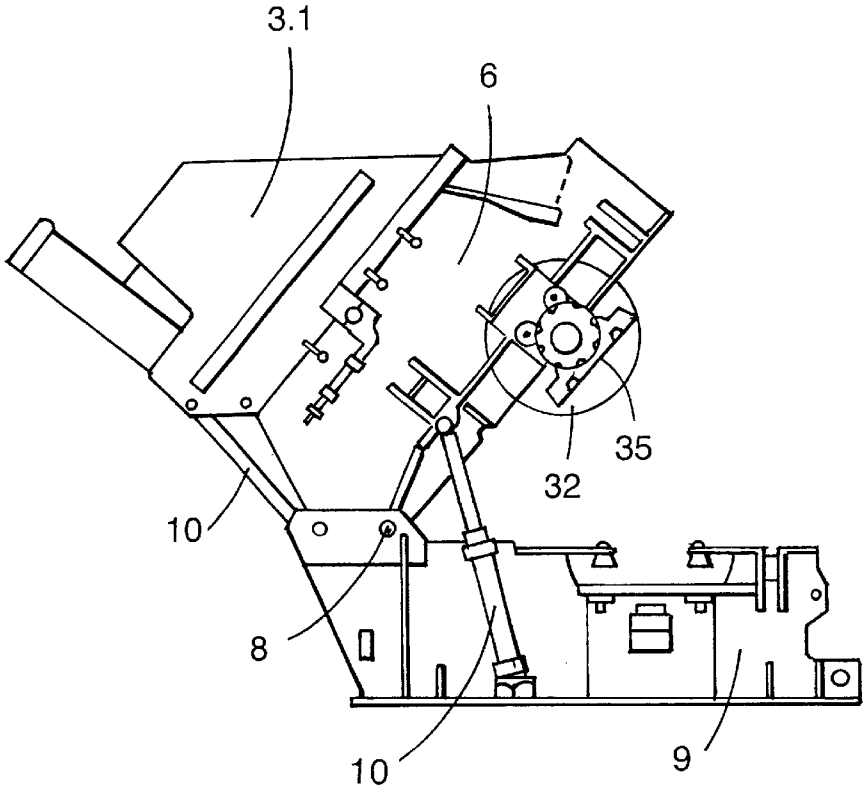
Figure 4E:
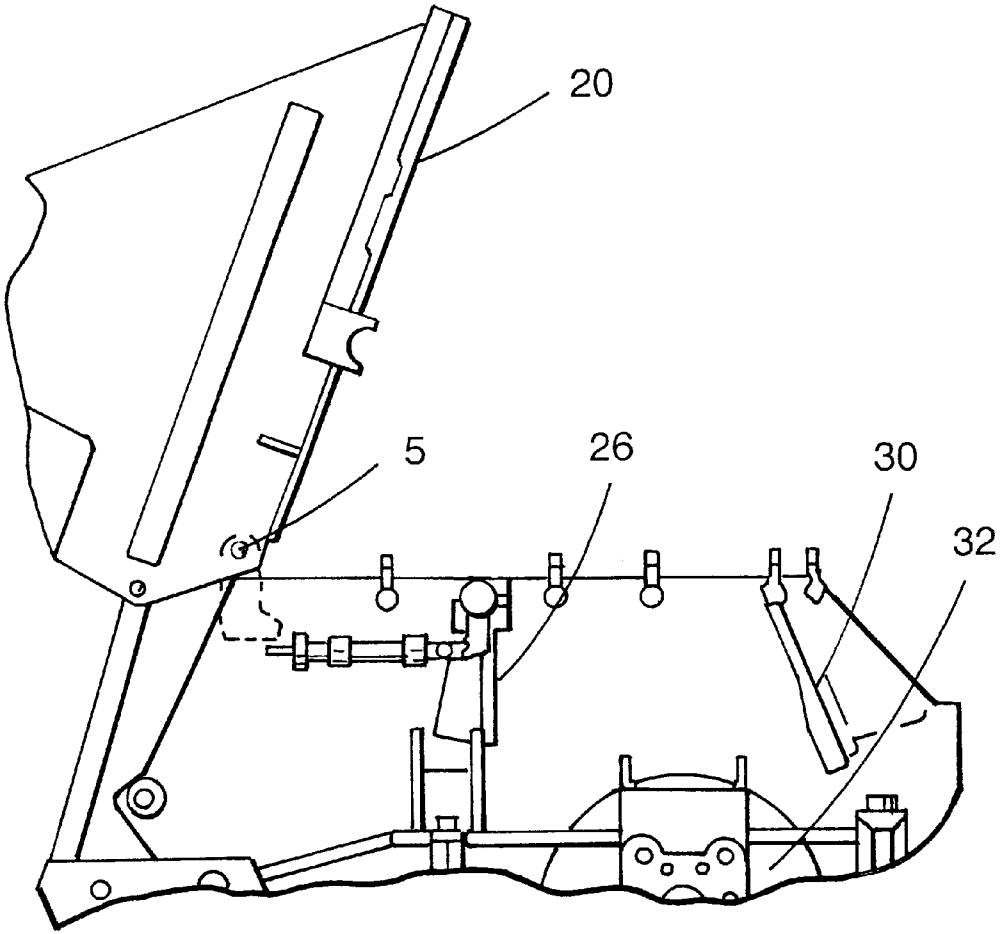

Advantageously, the housing 1 is adapted for convenient repair work, maintenance and/or service, as illustrated in FIG. 4, so that:

the upper housing section 3.1 alone as well as in conjunction with the center housing sections 6, can be pivoted with the help of a device 10 (FIG. 4*b*), *c*), *d*));

according to FIG. 4*c*), when the center housing section 6 is pivoted outwards together with the upper housing section 3.1, the rotor 32 is also lifted out together with the bearing 35 and is connected to the center housing section 6;

according to FIG. 4*b*), when the center housing section 6 is pivoted outwards together with the upper housing section 3.1, the rotor 32—together with the bearing 35—is connected the lower housing section 9; and/or when the upper housing section 3.1 is pivoted outwards according to FIG. 4*d*), *e*), the upper grate 20, the e.g. hydraulically actuable ejection door 26 and the impact wall segment 30 are accessible, so that the housing of the invention advantageously supports the beneficial effects of the invention described above.

Advantageously, both the comminution process and the wear characteristics can be matched to each other, if the ejection door 26 can be pivoted by the hydraulic actuating element (not described in detail) and forms an additional anvil 28 (FIG. 6), or assumes a position where the door 26 forms an additional grate 29 (FIG. 6), and simultaneously is made, e.g. cast, as a single piece and includes levers 27 (FIG. 6).

Figure 3A:
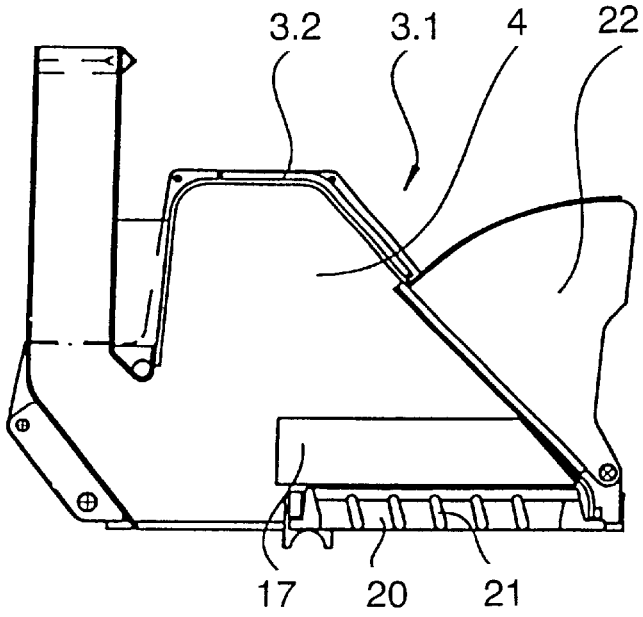
Figure 3B:
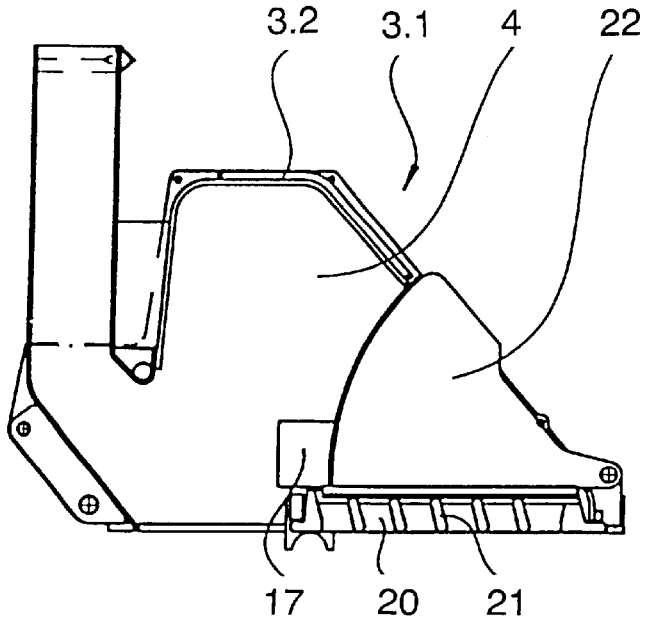

The comminution process and the wear characteristics can also be synergistically adjusted by operating a cover 22 for the upward grate 20 wherein the cover 22 is tiltably integrated with the upper housing section 3.1, as illustrated in FIG. 3.

The invention demonstrates that differentiated wear zones which are matched to the wear characteristics, can be easily provided in a housing adapted for comminution machines.

What is claimed is:

1. A comminution machine, comprising a housing, including an upper housing, a center housing and a lower housing and tools, the tools including inactive and active wear parts arranged in the housing, the inactive wear parts include interchangeable inactive wear plates and wherein the inactive wear parts include first and second wear parts and wherein the first wear parts are more wear-resistant than the second wear parts;

an opening in the housing for introducing material to be comminuted;

one of the inactive wear parts is formed as a grate;

an ejection door and an impact wall segment facing the ejection door and formed as one of the inactive wear parts;

the housing further comprises housing sections which are joined horizontally in at least one plane, wherein at least one of the housing sections is capable of being pivoted outwards about at least one pivot point; and wherein (a) at least sections of the inactive wear parts are attached to the housing with screws and form zones according to different wear characteristics so that the first wear parts are arranged around a rotor on the side walls of the housing, such that the combined characteristic features of the first wear parts, including at least arrangement, shape and material composition, provide matching wear characteristics of the housing and the rotor and approximately uniform maintenance intervals;

(b) the upper housing comprises a continuous, bent, thick plate and the wear parts are disposed on side walls and above an upper grate;

(c) the center housing section having side walls, which is provided between the upper grate and the rotor including first wear parts; and (d) a region around the rotor is provided on the side walls of the center housing section and a lower housing section with first wear parts.

2. The comminution machine according to claim 1, wherein the upper grate comprises unbreakable reinforced rods, an upper edge of the opening is coated to improve wear resistance, a continuous wear segment is disposed between an anvil and a lower grate, and the lower grate has lateral upwardly pointing edges which abut the wear parts and the wear segment, respectively, to protect against penetration by comminuted material.

3. The comminution machine according to claim 2, wherein the upper housing section, alone or in combination with the center housing sections, comprises a pivoting device.

4. The comminution machine according to claim 3, wherein the rotor may be lifted out together with a bearing and is connected to the center housing section when the center housing section is pivoted outwards together with the upper housing section.

5. The comminution machine according to claim 3, wherein the rotor and a bearing are connected with the lower housing section when the center housing section is pivoted outwards together with the upper housing section.

6. The comminution machine according to claim 3, wherein the upper grate, the ejection door and the impact wall segment are accessible for maintenance when the upper housing section is pivoted outwards.

7. The comminution machine according to claim 2, provided with tensioning elements between a support and a bearing, thereby to enable movement of the rotor relative to the support when bulky parts which are difficult to comminute enter the comminution machine.

8. The comminution machine according to claim 2, comprising a tensioning device for biasing the anvil against a support with a constant biasing force.

9. The comminution machine according to claim 2, wherein the upper grate comprises a cover which is integrated with the upper housing section and adapted for pivotal movement.

10. The comminution machine according to claim 1, wherein the upper housing section, alone or in combination with the center housing sections, comprises a pivoting device.

11. The comminution machine according to claim 10, wherein the rotor may be lifted out together with a bearing and is connected to the center housing section, when the center housing section is pivoted outwards together with the upper housing section.

12. The comminution machine according to claim 10, wherein the rotor and a bearing are connected with the lower housing section when the center housing section is pivoted outwards together with the upper housing section.

13. The comminution machine according to claim 10, wherein the upper grate, the ejection door and the impact wall segment are accessible for maintenance when the upper housing section is pivoted outwards.

14. The comminution machine according to claim 1, further comprising tensioning elements disposed between a support and a bearing so as to enable movement of the rotor relative to the support when bulky parts which are difficult to comminute enter the comminution machine.

15. The comminution machine according to claim 1, comprising a tensioning device for biasing an anvil against a support with a constant biasing force.

16. The comminution machine according to claim 1, wherein the ejection door is positioned to form an additional anvil.

17. The comminution machine according to claim 16, wherein the ejection door includes levers.

18. The comminution machine according to claim 1, wherein the ejection door is positioned to form an additional grate.

19. The comminution machine according to claim 1, wherein the ejection door includes levers.

20. The comminution machine according to claim 1, wherein the upper grate comprises a cover which is integrated with the upper housing section and adapted for pivotal movement.

* * * * *